US007382338B2

(12) United States Patent
Chen et al.

(10) Patent No.: US 7,382,338 B2
(45) **Date of Patent: *Jun. 3, 2008**

(54) DRIVER CIRCUIT FOR PLASMA DISPLAY PANELS

(75) Inventors: Bi-Hsien Chen, Ping-Tung Hsien (TW); Yi-Min Huang, Taipei (TW); Shin-Chang Lin, Taipei Hsien (TW); Liang-Che Cho, Hsin-Chu Hsien (TW)

(73) Assignee: Chunghwa Picture Tubes, Ltd., Chung-Shan, Taipei (TW)

( * ) Notice: Subject to any disclaimer, the term of this patent is extended or adjusted under 35 U.S.C. 154(b) by 498 days.

This patent is subject to a terminal disclaimer.

(21) Appl. No.: 10/908,610

(22) Filed: May 19, 2005

(65) Prior Publication Data

US 2006/0238448 A1 Oct. 26, 2006

Related U.S. Application Data

(63) Continuation-in-part of application No. 10/907,892, filed on Apr. 20, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66, 211, 212; 315/169.3, 315/169.4; 313/567
See application file for complete search history.

(56) References Cited

U.S. PATENT DOCUMENTS 5,670,974 A 9/1997 Ohba et al.
5,828,353 A 10/1998 Kishi et al.
6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
2003/0071578 A1 * 4/2003 Lee et al. ..... 315/169.3
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0135746 A1 * 7/2004 Lee et al. ..... 345/60
2006/0238447 A1 * 10/2006 Chen ..... 345/60
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A driver circuit for plasma display panels is provided. The claimed driver circuit includes four switches and an energy recovery circuit coupled to an equivalent capacitor of a plasma display panel. The present energy recovery circuit includes a first unit, coupled to ground and the X side of the equivalent capacitor, for passing current of charging/discharging the equivalent capacitor from the X side and/or Y side; and a second unit, coupled to the first unit and the Y side of the equivalent capacitor, for passing current of charging/discharging the equivalent capacitor from the Y side. With the aid of four voltage sources, it is not necessary for the present energy recovery circuit of the driver circuit to adopt capacitors for charging/discharging the equivalent capacitor of the plasma display panel.

22 Claims, 12 Drawing Sheets

DRIVER CIRCUIT FOR PLASMA DISPLAY PANELS

CROSS REFERENCE TO RELATED APPLICATIONS

This is a continuation-in-part of application Ser. No. 10/907,892, filed Apr. 20, 2005, and which is included in its entirety herein by reference.

BACKGROUND OF THE INVENTION

1. Field of the Invention

The present invention relates to a driver circuit, and more particularly, to a driver circuit for plasma display panels.

2. Description of the Prior Art

In recent years, there has been an increasing demand for planar matrix displays such as plasma display panels (PDP), liquid-crystal displays (LCD) and electroluminescent displays (EL display) in place of cathode ray tube terminals (CRT) due to the advantage of the thin appearance of the planar matrix displays. This kind of planar display is, in general, designed to achieve display through discharge glow in which charges accumulated over electrodes are released with application of a given voltage.

In a PDP display, charges are accumulated according to display data, and a sustaining discharge pulse is applied to paired electrodes in order to initiate discharge glow for display. As far as the PDP display is concerned, it is required to apply a high voltage to the electrodes. In particular, a pulse-duration of several microseconds is adopted usually. Hence the power consumption of the PDP display is quite considerable. Energy recovering (power saving) is therefore sought for. Many designs and patents have been developed for providing methods and apparatus of energy recovering for PDP. One of the examples is U.S. Pat. No. 5,828,353, *"Drive Unit for Planar Display"* by Kishi, et al., which is included herein by reference.

Please refer to FIG. 1. FIG. 1 is a block diagram of a prior art driver circuit 100. An equivalent capacitor of a plasma display panel is marked as Cpanel. The conventional driver circuit 100 includes four switches S1 to S4 for passing current, an X-side energy recovery circuit 110 and a Y-side energy recovery circuit 120 for charging/discharging the capacitor Cpanel from the X side of the capacitor Cpanel and the Y side of the capacitor Cpanel respectively. S5, S6, S7 and S8 are switches for passing current. D5, D6, D7 and D8 are diodes. V1 and V2 are two voltage sources. C1 and C2 are capacitors adopted for recovering energy, and L1 and L2 are resonant inductors. The X-side energy recovery circuit 110 includes an energy-forward channel comprising the switch S6, the diode D6 and the inductor L1, and an energy-backward channel comprising the inductor L1, the diode D5 and the switch S5. Similarly, the Y-side energy recovery circuit 120 also includes an energy-forward channel comprising the switch S8, the diode D8 and the inductor L2, and an energy-backward channel comprising the inductor L2, the diode D7 and the switch S7.

Please refer to FIG. 2. FIG. 2 is a flowchart of generating the sustaining pulses of the equivalent capacitor Cpanel of the PDP by the conventional driver circuit 100 illustrated in FIG. 1.

Step 200: Start;

Step 210: Keep the voltage potentials at the X side and the Y side of the capacitor Cpanel at ground by turning on the switches S3 and S4 and turning off other switches;

Step 220: Charge the X side of the capacitor Cpanel by the capacitor C1 and keep the voltage potential at the Y side of the capacitor Cpanel at ground by turning on the switches S6 and S4 and turning off other switches; wherein the voltage potential at the X side of the capacitor Cpanel goes up to V1 accordingly;

Step 230: Ignite the equivalent capacitor Cpanel of the PDP from the X side by turning on the switches S1 and S4 and turning off other switches; wherein the voltage potential at the X side of the capacitor Cpanel keeps at V1 and the voltage potential at the Y side of the capacitor Cpanel keeps at ground accordingly;

Step 240: Discharge the capacitor Cpanel from the X side and keep the voltage potential at the Y side of the capacitor Cpanel at ground by turning on the switches S5 and S4 and turning off other switches; wherein the voltage potential at the X side of the capacitor Cpanel goes down to ground accordingly;

Step 250: Keep the voltage potentials at the X side and the Y side of the capacitor Cpanel at ground by turning on the switches S3 and S4 and turning off other switches;

Step 260: Charge the Y side of the capacitor Cpanel by the capacitor C2 and keep the voltage potential at the X side of the capacitor Cpanel at ground by turning on the switches S8 and S3 and turning off other switches; wherein the voltage potential at the Y side of the capacitor Cpanel goes up to V2 accordingly;

Step 270: Ignite the equivalent capacitor Cpanel of the PDP from the Y side by turning on the switches S2 and S3 and turning off other switches; wherein the voltage potential at the Y side of the capacitor Cpanel keeps at V2 and the voltage potential at the X side of the capacitor Cpanel keeps at ground accordingly;

Step 280: Discharge the capacitor Cpanel from the Y side and keep the voltage potential at the X side of the capacitor Cpanel at ground by turning on the switches S7 and S3 and turning off other switches; wherein the voltage potential at the Y side of the capacitor Cpanel goes down to ground accordingly;

Step 290: Keep the voltage potentials at the X side and the Y side of the capacitor Cpanel at ground by turning on the switches S3 and S4 and turning off other switches;

Step 295: End.

Please refer to FIG. 3. FIG. 3 shows a diagram illustrating the voltage potentials at the X side and the Y side of the capacitor Cpanel, and the control signals, M1 to M8, of the switches S1 to S8 in FIG. 1 respectively. In FIG. 3, the horizontal axis represents the time, while the vertical axis represents the voltage potential. Note that the switches S1 to S8 are designed to close (turned on) for passing current when the control signal is high, and to open (turned off) such that no current can pass when the control signal is low.

Conventionally, the energy recovery (power saving) circuit provides two individual channels of charging and discharging the equivalent capacitor respectively (energy-forward channel and energy-backward channel) for each side of the equivalent capacitor Cpanel. Further, each individual channel of charging and discharging each side of the equivalent capacitor adopts a capacitor to implement the energy recovery job. Therefore, the amount of required components is quite large. Furthermore, the area of capacitors C1 and C2 is usually considerable. Hence the cost of energy recovery circuit is not easy to reduce.

SUMMARY OF INVENTION

It is therefore a primary objective of the claimed invention to provide a driver circuit for plasma display panels.

Briefly described, the claimed invention discloses a driver circuit for plasma display panels. The claimed driver circuit includes a first switch having a first end coupled to a first voltage source and a second end coupled to an X side of an equivalent capacitor of a plasma display panel, a second switch having a first end coupled to a second voltage source and a second end coupled to a Y side of the equivalent capacitor of the plasma display panel, a third switch having a first end coupled to the second end of the first switch and a second end coupled to a third voltage source, a fourth switch having a first end coupled to the second end of the second switch and a second end coupled to a fourth voltage source, and an energy recovery circuit that does not need to adopt a capacitor. The present energy recovery circuit includes two units. The first unit is coupled to the X side of the equivalent capacitor and coupled to ground, and is for passing current of charging and/or discharging the equivalent capacitor from the X side and/or Y side; and the second unit is coupled to the Y side of the equivalent capacitor and coupled to the first unit, and is for passing current of charging and/or discharging the equivalent capacitor from the Y side.

It is an advantage of the present invention that in the energy recovery circuit, for all of the energy-forward channels and the energy-backward channels of the X-side driver and the Y-side driver of the energy recovering circuit, it is not necessary to adopt a capacitor to implement the energy recovery. The drawback of the great amount of required components in prior art is moderated, and the area of chips is hence reduced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
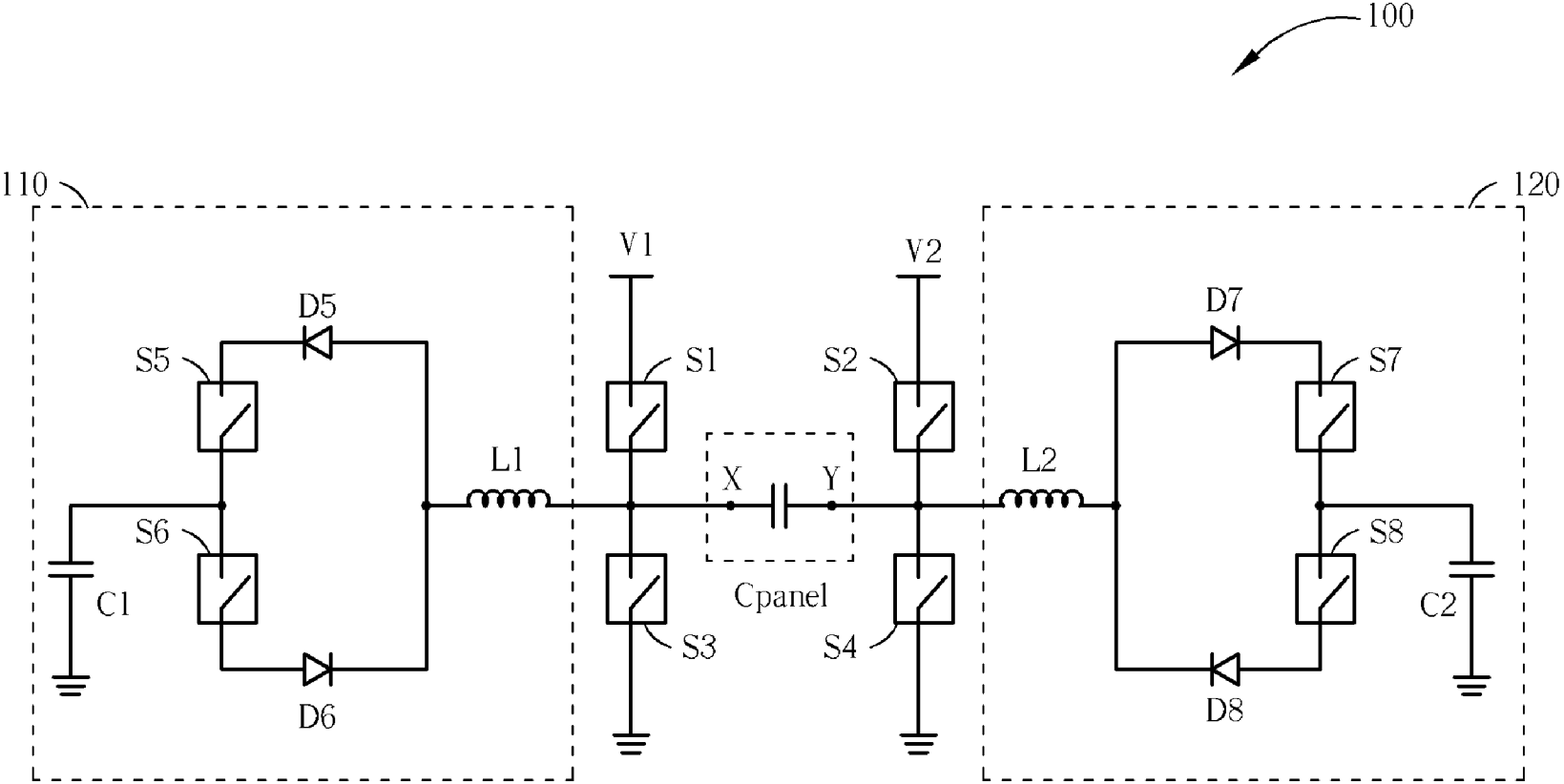
Fig. 1 Prior art
FIG. 1 is a block diagram of a prior art energy recovery circuit with an equivalent capacitor of a PDP.
Figure 2:
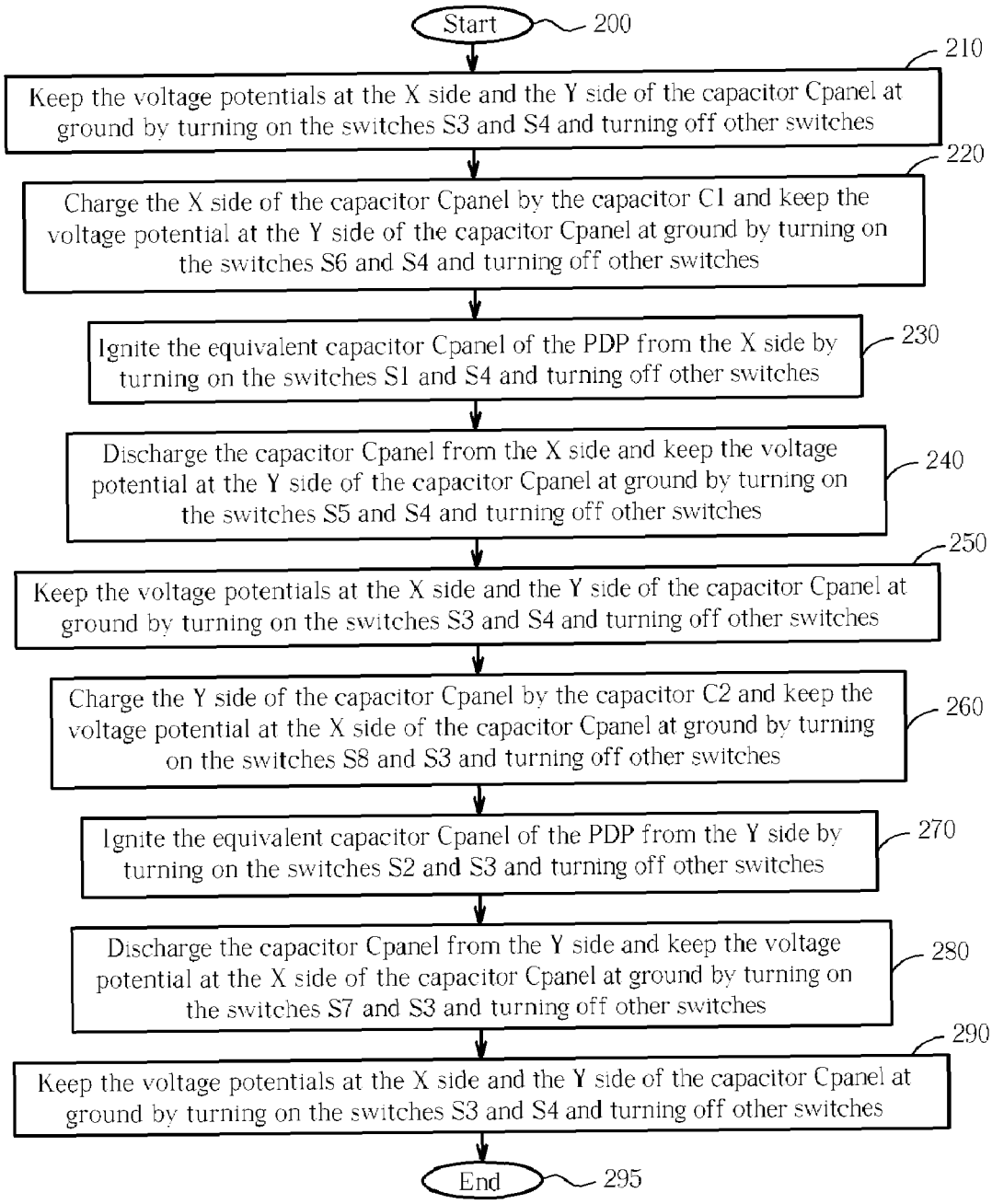
Fig. 2 Prior art
FIG. 2 is a flowchart of a prior art method of generating the sustaining pulses of the equivalent capacitor Cpanel.
Figure 3:
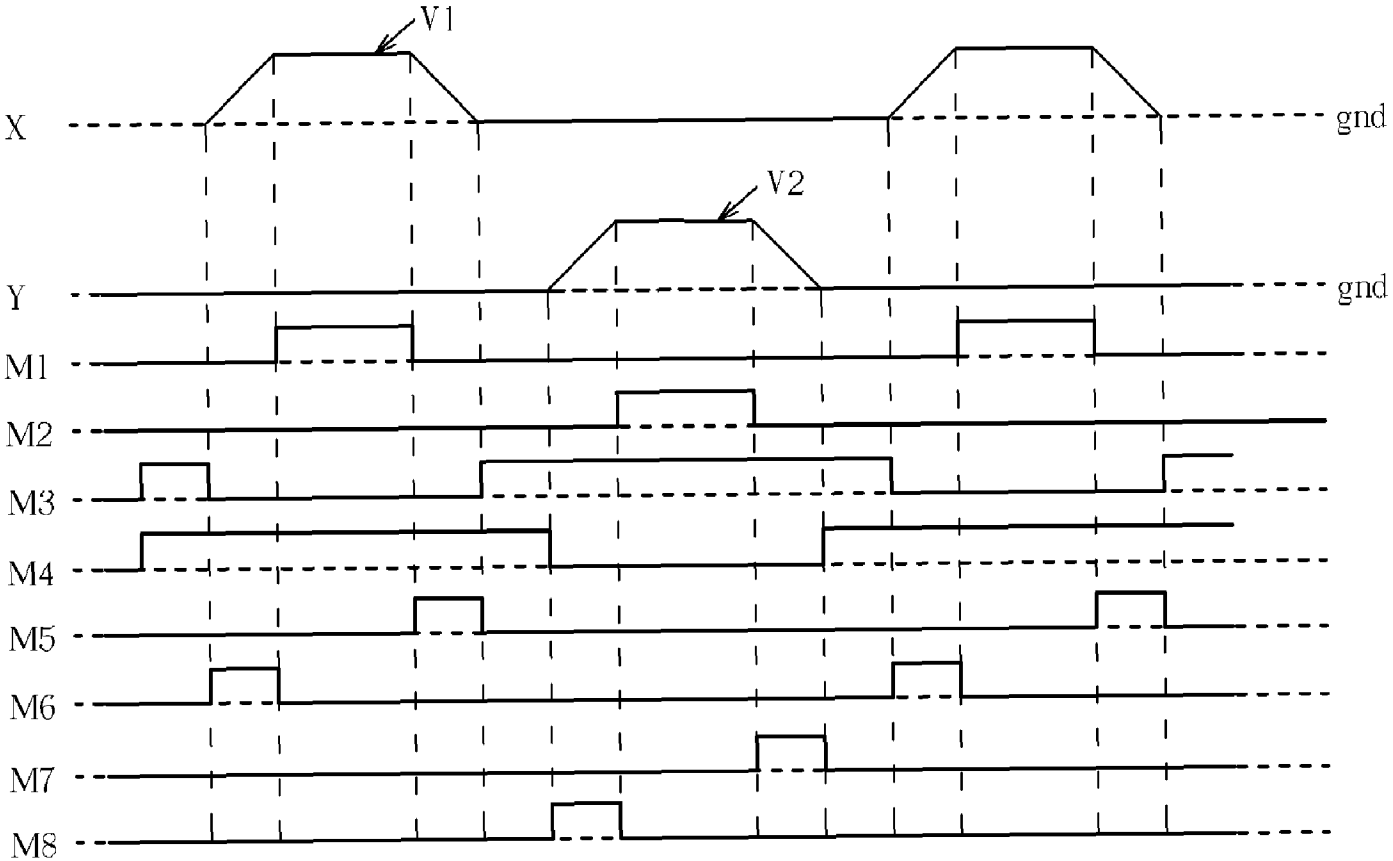
Fig. 3 Prior art
FIG. 3 is a diagram illustrating the voltage potentials at sides of the capacitor Cpanel and the control signals of the switches.
Figure 4:
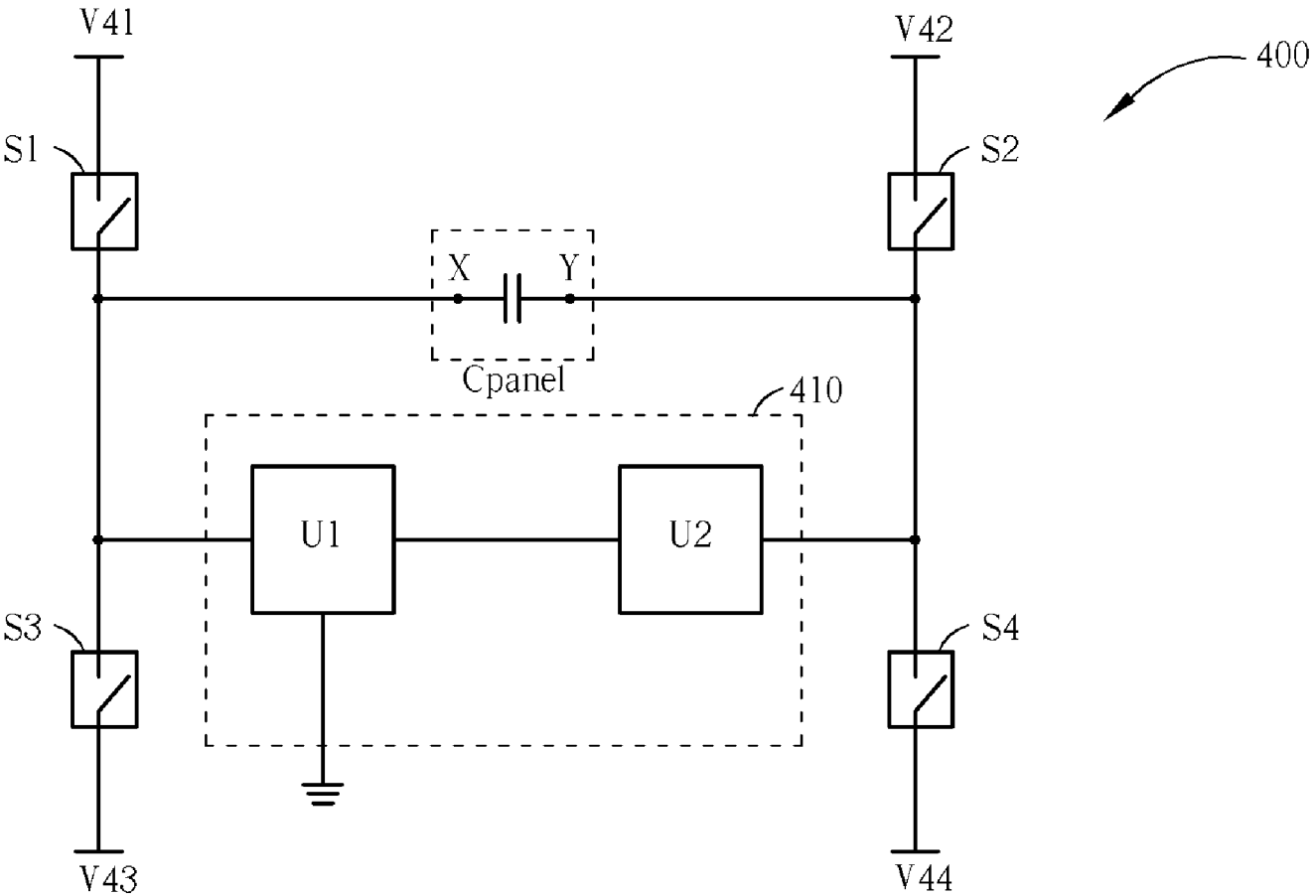
FIG. 4 is a block diagram of a present invention driver circuit with an equivalent capacitor of a PDP.

Please refer to FIG. 4. FIG. 4 is a block diagram of the present invention driver circuit 400 and an equivalent capacitor of a PDP (plasma display panel), Cpanel. Unlike the prior art, four voltage sources V41, V42, V43 and V44 are provided to the present driver circuit 400 and the equivalent capacitor Cpanel. The functions and connections of the switches S1, S2, S3 and S4 are similar to the functions and connections of the switches S1, S2, S3 and S4 illustrated in FIG. 1. The present invention driver circuit 400 includes an energy recovery circuit 410 for charging/discharging the equivalent capacitor Cpanel. The energy recovery circuit 410 includes two units. A first unit U1, coupled to ground and the X side of the equivalent capacitor Cpanel, is for passing current of charging and/or discharging the equivalent capacitor Cpanel from the X side. In addition, the first unit U1 is for passing current from/toward a second unit U2, that is, current from/toward the Y side of the equivalent capacitor Cpanel. The second unit U2 is coupled to the first unit and the Y side of the equivalent capacitor, for passing current of charging and/or discharging the equivalent capacitor from the Y side.

The third voltage source V43 and the fourth voltage source V44 may be some negative voltage sources of which the absolute values are around the values of the positive voltage sources V41 and V42 respectively. Therefore, while there are two capacitors C1 and C2 needed for energy recovery in the two conventional energy recovery circuits 110 and 120 of the driver circuit 100 respectively, it is not necessary for the driver circuit 400 of the present invention to adopt any capacitor.

Figure 5:
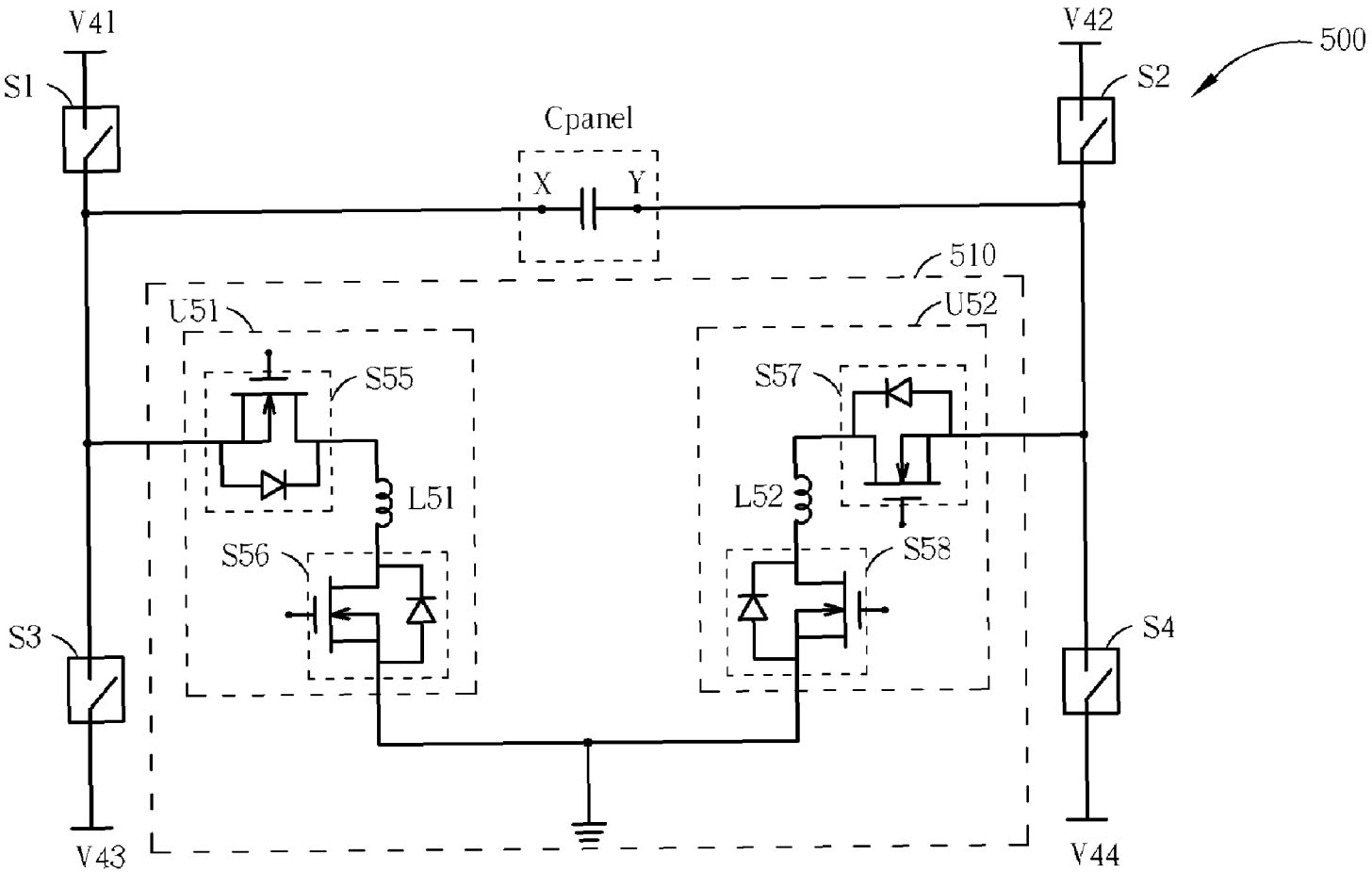
FIG. 5 is a block diagram of the first embodiment of the present invention driver circuit with an equivalent capacitor of a PDP.

In each channel for passing both the current charging the capacitor Cpanel and the current discharging the capacitor Cpanel, it is necessary to adopt a bidirectional switch, or two switches that together implement the bidirectional control. Please refer to FIG. 5. FIG. 5 is a block diagram of the first embodiment 500 of the present invention driver circuit. In the energy recovery circuit 510 of this embodiment, a unit U51 includes two switches S55 and S56 for passing current in opposite directions and an inductor L51 coupled in series, and a unit U52 includes two switches S57 and S58 for passing current in opposite directions and an inductor L52 coupled in series as well. The unit U51 is coupled to ground, and the unit U52 is coupled to the unit U51 at the joint to ground. The switches S55 to S58 of the units U51 and U52 can properly control the direction of current from/toward the X side and/or the Y side of the capacitor Cpanel to fulfill the job of charging/discharging the X-side and/or the Y-side of the equivalent capacitor Cpanel.

Figure 6:
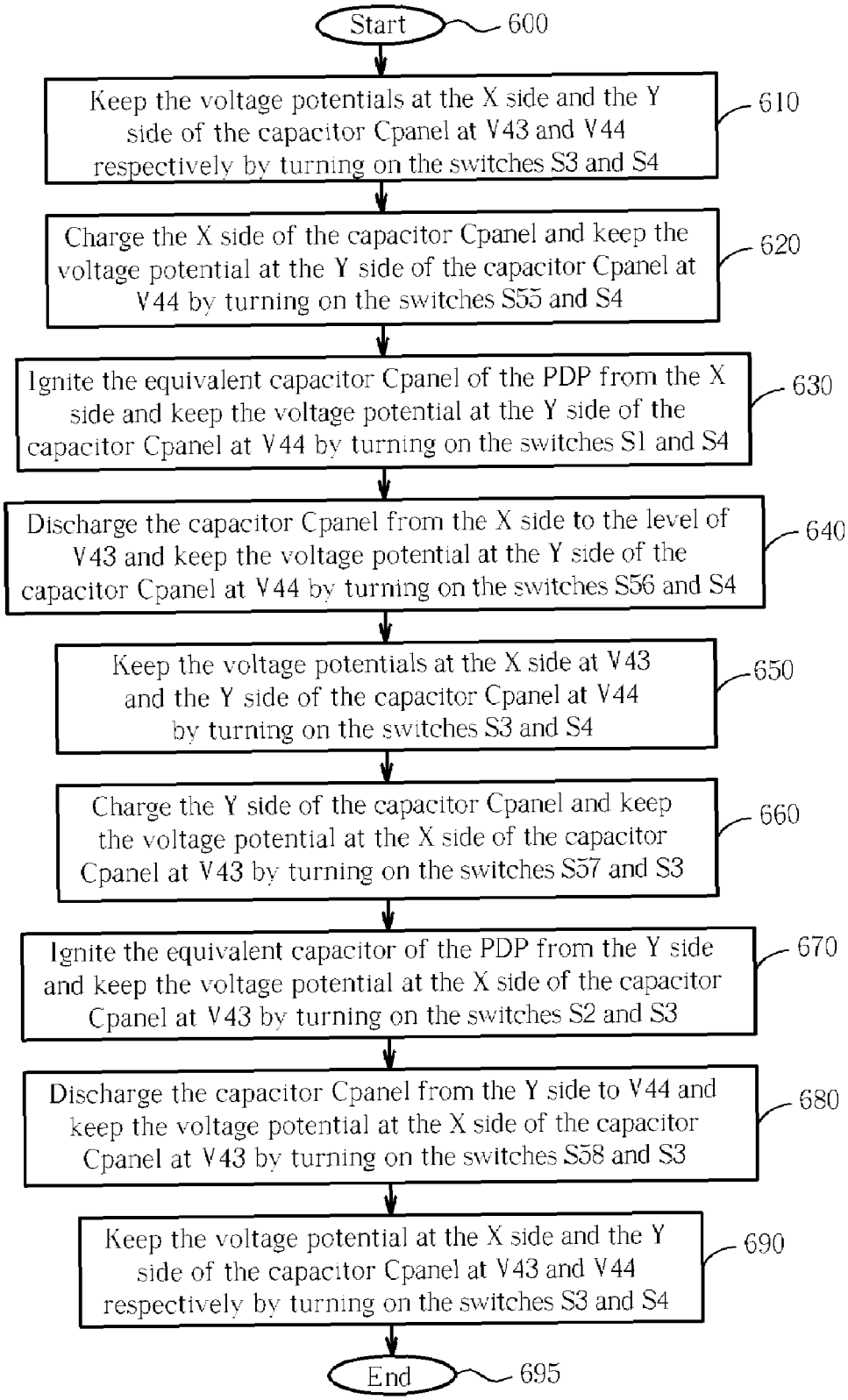
FIG. 6 is a flowchart of the present invention method of generating the sustaining pulses of the equivalent capacitor Cpanel.

Please refer to FIG. 6. FIG. 6 is a flowchart of generating the sustaining pulses of the equivalent capacitor Cpanel of the PDP by the first embodiment 500 of the present invention driver circuit illustrated in FIG. 5.

Step 600: Start;

Step 610: Keep the voltage potentials at the X side and the Y side of the capacitor Cpanel at V43 and V44 respectively by turning on the switches S3 and S4;

Step 620: Charge the X side of the capacitor Cpanel and keep the voltage potential at the Y side of the capacitor Cpanel at V44 by turning on the switches S55 and S4; wherein the voltage potential at the X side of the capacitor Cpanel goes up to V41 and the voltage potential at the Y side of the capacitor Cpanel keeps at V44 accordingly;

Step 630: Ignite the equivalent capacitor Cpanel of the PDP from the X side and keep the voltage potential at the Y side of the capacitor Cpanel at V44 by turning on the switches S1 and S4; wherein the voltage potential at the X side of the capacitor Cpanel keeps at V41 and the voltage potential at the Y side of the capacitor Cpanel keeps at the level of V44 accordingly;

Step 640: Discharge the capacitor Cpanel from the X side to the level of V43 and keep the voltage potential at the Y side of the capacitor Cpanel at V44 by turning on the switches S56 and S4; wherein the voltage potential at the X side of the capacitor Cpanel goes down to the level of V43 and the voltage potential at the Y side of the capacitor Cpanel keeps at V44 accordingly;

Step 650: Keep the voltage potentials at the X side at V43 and the Y side of the capacitor Cpanel at V44 by turning on the switches S3 and S4;

Step 660: Charge the Y side of the capacitor Cpanel and keep the voltage potential at the X side of the capacitor Cpanel at V43 by turning on the switches S57 and S3; wherein the voltage potential at the Y side of the capacitor Cpanel goes up to V42 and the voltage potential at the X side of the capacitor Cpanel keeps at V43 accordingly;

Step 670: Ignite the equivalent capacitor of the PDP from the Y side and keep the voltage potential at the X side of the capacitor Cpanel at V43 by turning on the switches S2 and S3; wherein the voltage potential at the Y side of the capacitor Cpanel keeps at V42 and the voltage potential at the X side of the capacitor Cpanel keeps at V43 accordingly;

Step 680: Discharge the capacitor Cpanel from the Y side to V44 and keep the voltage potential at the X side of the capacitor Cpanel at V43 by turning on the switches S58 and S3; wherein the voltage potential at the Y side of the capacitor Cpanel goes down to the level of V44 and the voltage potential at the X side of the capacitor Cpanel keeps at V43 accordingly;

Step 690: Keep the voltage potential at the X side and the Y side of the capacitor Cpanel at V43 and V44 respectively by turning on the switches S3 and S4;

Step 695: End.

In the unit U51 of the first embodiment 500 of the present invention energy recovery circuit, the inductor L51 and the two switches S55 and S56 for opposite directions are coupled in series; and in the unit U52, the inductor L52 and the two switches S57 and S58 for opposite directions are coupled in series. Note that the order of the three components included in each of the unit U51 and the unit U52 can be varied anyway. Additionally, since each of the unit U51 and the unit U52 adopts only one inductor for both charging path and discharging path, the curves of the voltage potentials in the charging stage and the discharging stage of each side of the capacitor Cpanel are identical, while the curves of the voltage potentials in the charging stages or the discharging stages of different sides of the capacitor Cpanel may be different.

Figure 7:
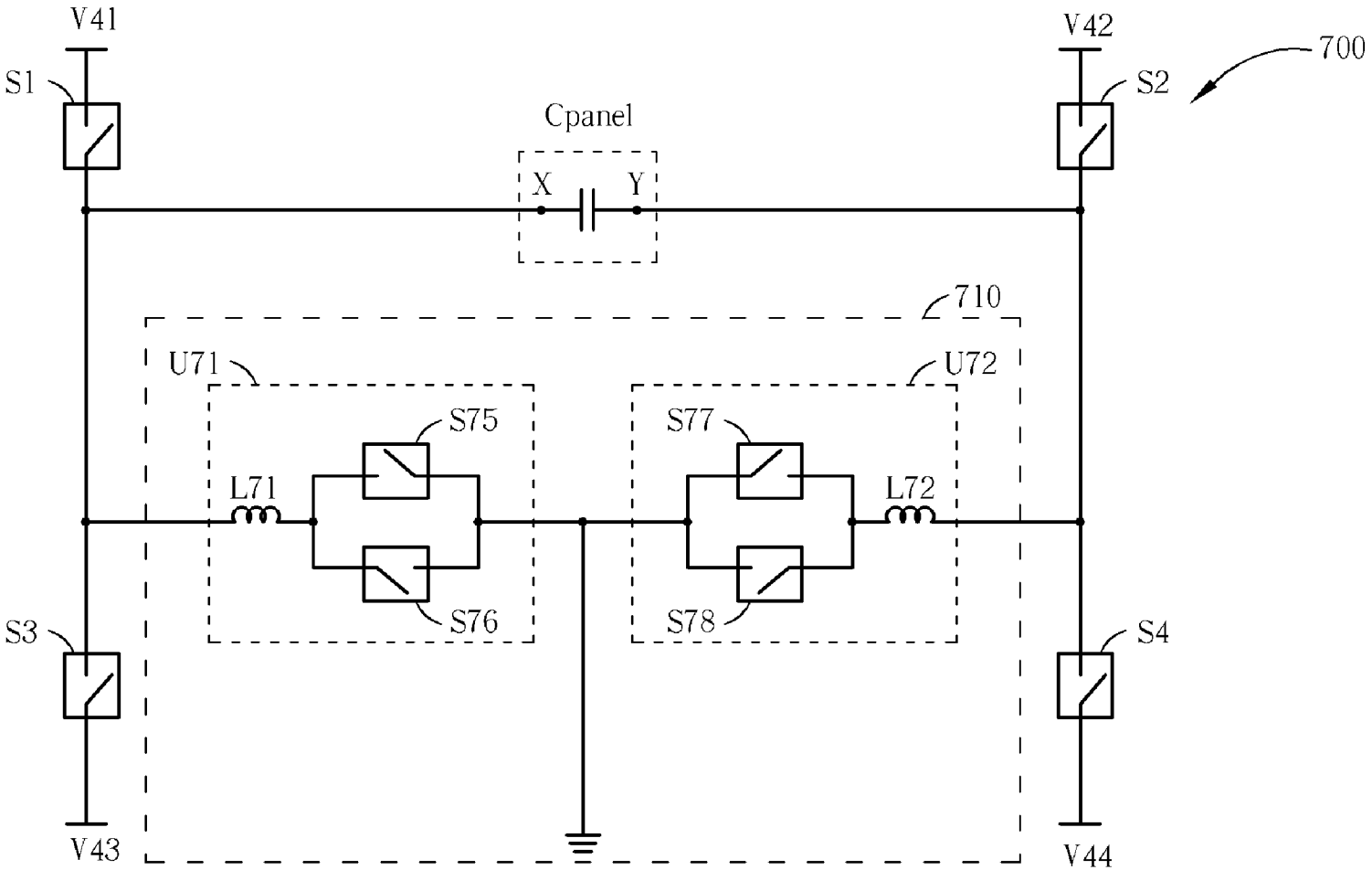
FIG. 7 is a block diagram of the second embodiment of the present invention driver circuit with an equivalent capacitor of a PDP.

In the illustration of the first embodiment 500 of the claimed driver circuit in FIG. 5, each of the switches S55, S56, S57 and S58 is a N-type metal oxide semiconductor (NMOS) with a parasitic diode, behaving as a unidirectional switch. Please refer to FIG. 7. FIG. 7 illustrates another embodiment of the present invention driver circuit 700. The difference between the energy recovery circuit 710 and the energy recovery circuit 510 is that each of the two units U71 and U72 adopts two parallel unidirectional switches rather than two serial unidirectional switches. The two parallel unidirectional switches can be seen as a bi-directional switch accordingly.

Figure 8:
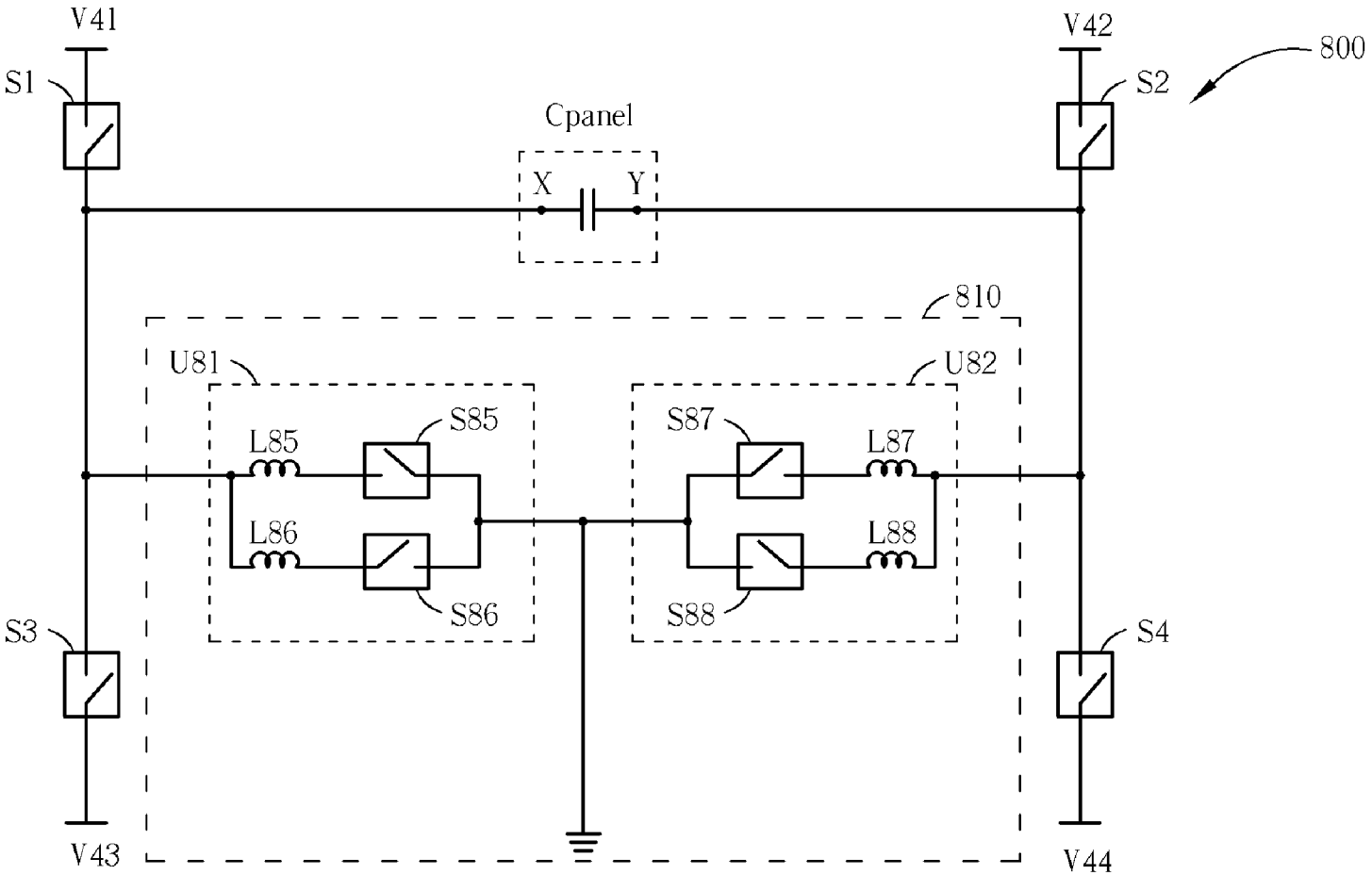
FIG. 8 is a block diagram of a third embodiment of the present invention driver circuit with an equivalent capacitor of a PDP.

The slopes of the curves of the voltage potentials in the charging stages and the discharging stages are decided in accordance with the inductances of adopted inductors of the energy recovery circuit of the present invention driver circuit, and may be varied by adopting different inductances. Please refer to FIG. 8. FIG. 8 is a block diagram of a third embodiment 800 of the present invention driver circuit with an equivalent capacitor, Cpanel, of a PDP. When charging the X side of the capacitor Cpanel, the switch S85 is turned on, and the X side of the capacitor Cpanel is charged through the inductor L85. When discharging the X side of the capacitor Cpanel, the switch S86 is turned on for passing current from the X side of the capacitor Cpanel through the inductor L86 toward ground. Similarly, when charging the Y side of the capacitor Cpanel, the switch S87 is turned on, and the Y side of the capacitor Cpanel is charged through the inductor L87. And when discharging the Y side of the capacitor Cpanel, the switch S88 is turned on for passing current from the Y side of the capacitor Cpanel through the inductor L88 toward ground as well. As long as the inductances of the four inductors L85, L86, L87 and L88 are well designed, the slopes of the curves of the voltage potentials at the X side and the Y side of the equivalent capacitor Cpanel in the charging stages and the discharging stages can meet requirements appropriately.

Figure 9:
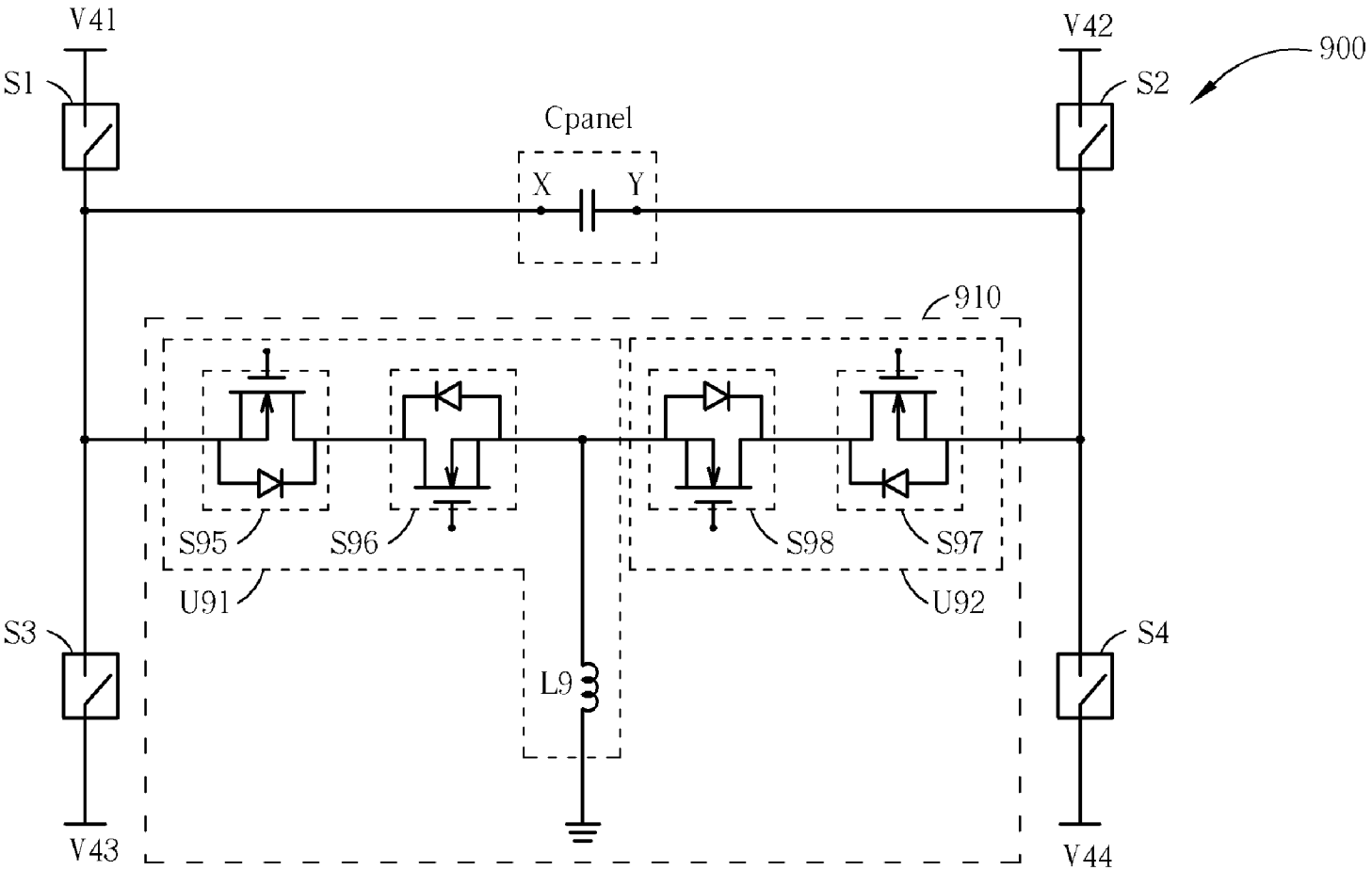
FIG. 9 is a block diagram of a fourth embodiment of the present invention driver circuit with an equivalent capacitor of a PDP.

Please refer to FIG. 9. FIG. 9 is a block diagram of a fourth embodiment 900 of the present invention driver circuit with an equivalent capacitor Cpanel of a PDP. In this embodiment, the unit U92 is coupled to the unit U91 at an end of an inductor L9. Therefore, the paths of charging/discharging the X side/the Y side of the equivalent capacitor Cpanel share the same inductor L9. In FIG. 9, it can be seen that the bidirectional switch of the unit U91 is implemented by two switches S95 and S96 connected in series, and the bidirectional switch of the unit U92 is implemented by two switches S97 and S98 connected in series. Compared to the aforementioned energy recovery circuits, the amount of adopted components of the energy recovery circuit 910 is further reduced. When charging the X side of the capacitor Cpanel and keeping the voltage potential at the Y side of the capacitor Cpanel at V44, the switches S95 and S4 are turned on. When discharging the capacitor Cpanel from the X-side to V43 and keeping the voltage potential at the Y-side of the capacitor Cpanel at V44, the switches S96 and S4 are turned on. On the other side, when charging the Y side of the capacitor Cpanel and keeping the voltage potential at the X side of the capacitor Cpanel at V43, the switches S97 and S3 are turned on. And when discharging the capacitor Cpanel from the Y side to V44 and keeping the voltage potential at the X side of the capacitor Cpanel at V43, the switches S98 and S3 are turned on.

Figure 10:
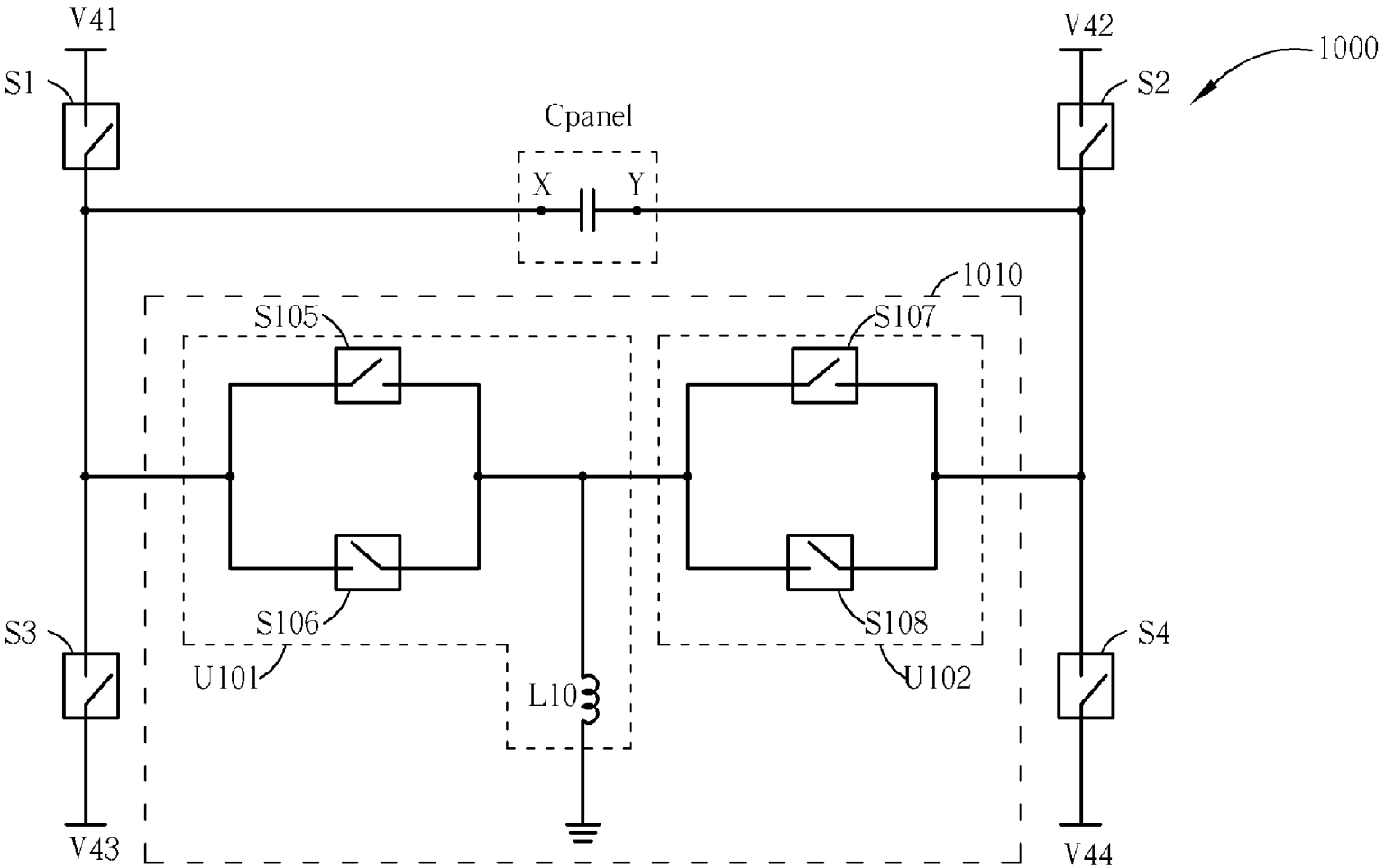
FIG. 10 is a block diagram of a fifth embodiment of the present invention driver circuit with an equivalent capacitor of a PDP.

Please refer to FIG. 10. FIG. 10 is a block diagram of a fifth embodiment 1000 of the present invention driver circuit with an equivalent capacitor Cpanel of a PDP. The second unit U102 is connected to the first unit U101 at one end of an inductor L10 of the unit U101 as in the last embodiment 900. In the units U101 and U102 of the claimed energy recovery circuit 1010 of the driver circuit 1000, the bidirectional switches utilized for passing currents toward and from the capacitor Cpanel are implemented by two parallel switches. The switches S105, S106, S107 and S108 are illustrated by simple switch symbols in FIG. 10 instead of symbols of transistors.

Figure 11:
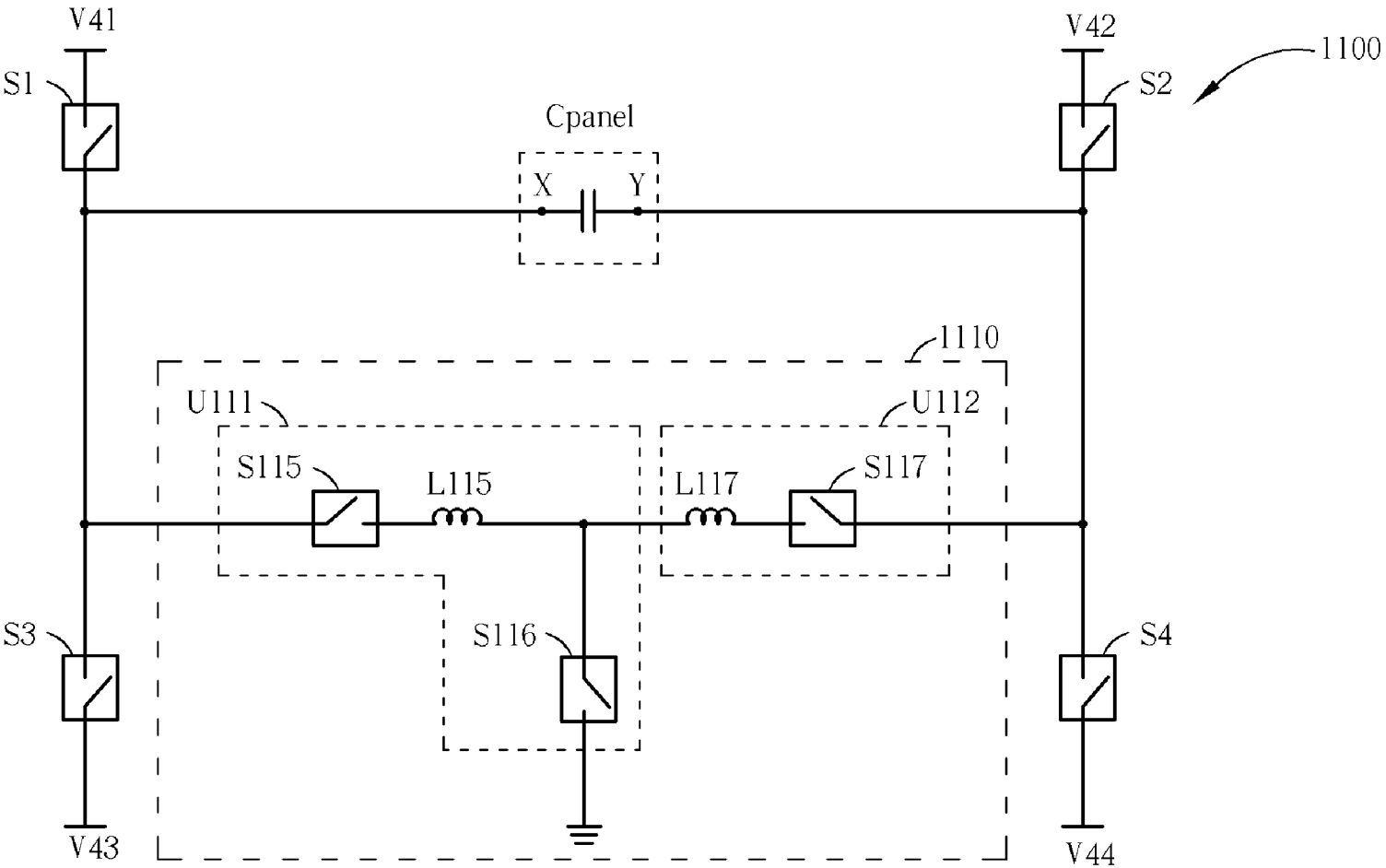
FIG. 11 is a block diagram of a sixth embodiment of the present invention driver circuit with an equivalent capacitor of a PDP.

Please refer to FIG. 11. FIG. 11 illustrated an embodiment 1100 of the present invention driver circuit. In the energy recovery circuit 1110 of the driver circuit 1100, the unit U112 is coupled to an end of a switch S16 of the unit U111. Therefore the switch S116 is utilized in both the path of charging/discharging the X side and/or the Y side of the equivalent capacitor Cpanel. The unit U112 only needs to adopt one switch S117 and an inductor L117 in consequence. When charging/discharging the X side of the capacitor Cpanel, the switch S116 and the switch S115 are turned on for passing current toward/from the X side of the capacitor Cpanel. In a similar manner, the switch S116 and the switch S117 are turned on for passing current toward/from the Y side of the capacitor Cpanel when charging/discharging the Y side of the capacitor Cpanel.

Figure 12:
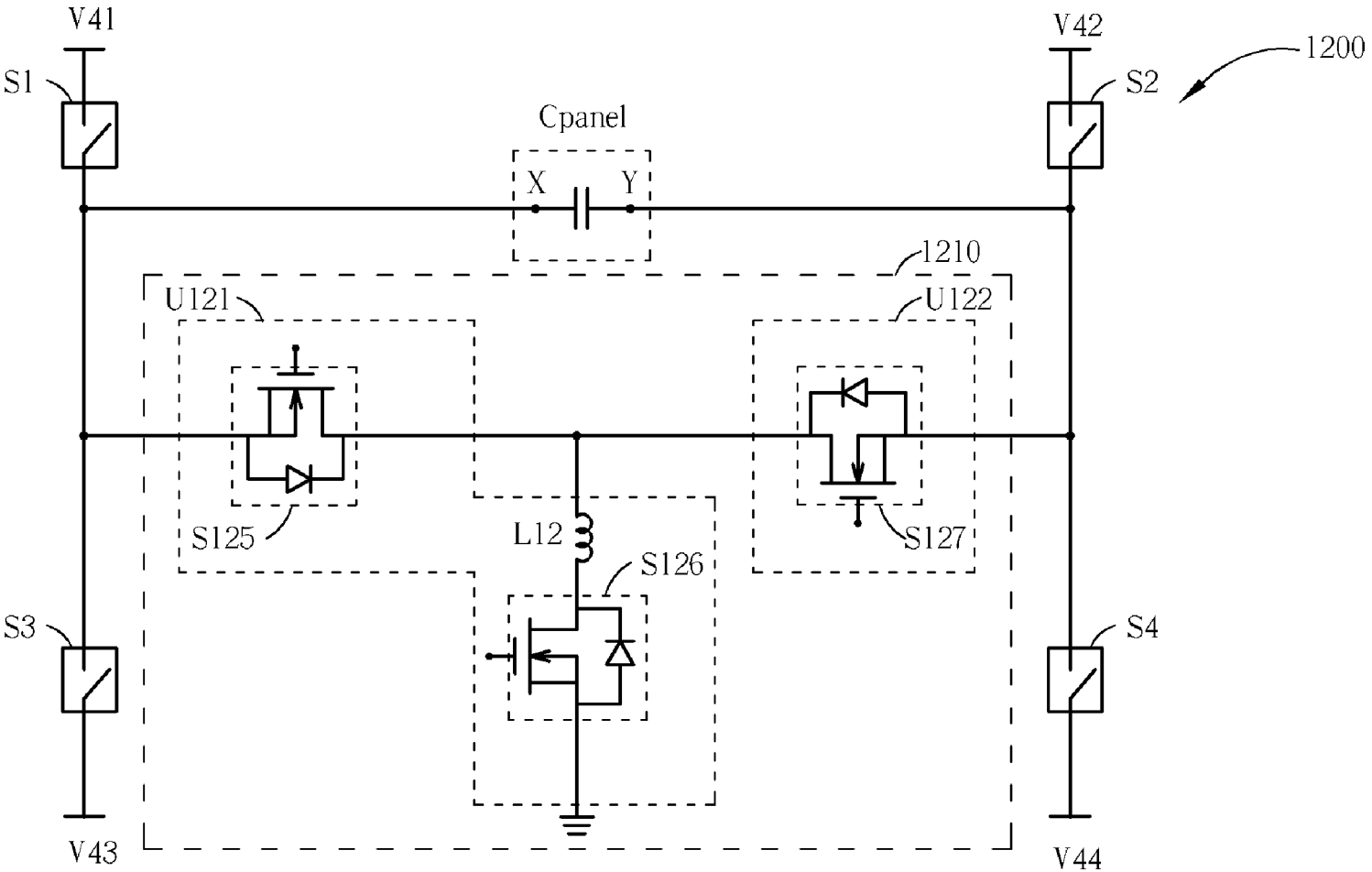
FIG. 12 is a block diagram of a seventh embodiment of the present invention driver circuit with an equivalent capacitor of a PDP.

Please refer to FIG. 12. FIG. 12 is a block diagram of another embodiment 1200 of the present invention driver circuit with an equivalent capacitor Cpanel of a PDP. In this embodiment, not only the inductor L12, but also the switch S126 is adopted in both the energy recovery path of the X-side of the capacitor Cpanel and the energy recovery path of the Y-side of the capacitor Cpanel as well. When charging the X side of the capacitor Cpanel and keeping the voltage potential at the Y side of the capacitor Cpanel at V44, the switches S125 and S4 are turned on. When discharging the X side of the capacitor Cpanel to V43 and keeping the voltage potential at the Y side of the capacitor Cpanel at V44, the switches S126 and S4 are turned on. When charging the Y side of the capacitor Cpanel and keeping the voltage potential at the X side of the capacitor Cpanel at V43, the switches S127 and S3 are turned on. And when discharging the Y side of the capacitor Cpanel to V44 and keeping the voltage potential at the X side of the capacitor Cpanel at V43, the switches S126 and S3 are turned on. The amount of adopted components is further decreased.

In the embodiments 500, 700, 900, 1000, 1100 and 1200 of the present invention driver circuit, for each side of the capacitor Cpanel, the energy forward channel and the energy backward channel share the same inductor. Therefore, for the same side of the equivalent capacitor Cpanel, the slopes of the curves of the voltage potential in the charging stage and in the discharging stage are of the same absolute value. Furthermore, if the inductances of the inductors utilized to charge the X side of the capacitor Cpanel and the Y side of the capacitor Cpanel are the same, or if the inductor utilized to charge the X side of the capacitor Cpanel is the same as the inductor utilized to charge the Y side of the capacitor Cpanel, the slopes of the curves of the voltage potentials at the X side and the Y side in the charging stages and the discharging stages will be the same. The embodiments 900, 1000 and 1200 of the claimed driver circuit are examples. Contrarily, if the inductor utilized to charge the X side of the capacitor Cpanel is different from the inductor utilized to charge the Y side of the capacitor Cpanel, and the two inductances are different, the slopes of the curves of the voltage potentials at the X side of the equivalent capacitor in the charging stages and the slopes of the curves of the voltage potentials at the Y side of the equivalent capacitor in the charging stages will be different. That is, the slopes of the voltage curves at the X side and the Y side of the equivalent capacitor can be well controlled by adopting appropriate inductors.

In summary, with the supply of four voltage sources, the claimed invention provides a driver circuit that does not utilize capacitors in all of energy-forward channels and energy-backward channels of the X side and the Y side of the equivalent capacitor of a plasma display panel. The required amount of utilized components in the present invention energy recovery circuit and the number of control ICs are decreased accordingly, while the recovery rate of energy is maintained. The absolute values of the two negative voltage sources can be well designed around the values of the two positive voltage sources. Different variations of the order and connections of the switches and inductors are introduced for different advantages. Therefore, the important task of power saving in the PDP display is achieved more efficiently and with lower cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, the first unit comprising:

a fifth switch for passing current toward the X side of the equivalent capacitor;

a sixth switch for passing current from the X side of the equivalent capacitor; and an inductor;

wherein the fifth switch, the sixth switch and the inductor are coupled in series; and a second unit, coupled to the Y side of the equivalent capacitor and coupled to the first unit, for passing current of charging and/or discharging the equivalent capacitor from the Y side.

2. The driver circuit of claim 1 wherein the second unit comprises:

a seventh switch for passing current toward the Y side of the equivalent capacitor;

an eighth switch for passing current from the Y side of the equivalent capacitor; and an inductor;

wherein the seventh switch, the eighth switch and the inductor are coupled in series; and the second unit is further coupled to ground.

3. The driver circuit of claim 1 wherein the first voltage source is equal to the second voltage source.

4. The driver circuit of claim 1 wherein the first voltage source is different from the second voltage source.

5. The driver circuit of claim 1 wherein the third voltage source is equal to the fourth voltage source.

6. The driver circuit of claim 1 wherein the third voltage source is different from the fourth voltage source.

7. The driver circuit of claim 1 wherein the first voltage source is a positive voltage source.

8. The driver circuit of claim 1 wherein the second voltage source is a positive voltage source.

9. The driver circuit of claim 1 wherein the third voltage source is a negative voltage source.

10. The driver circuit of claim 1 wherein the fourth voltage source is a negative voltage source.

11. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, wherein the first unit comprises:

a fifth switch for passing current toward the X side of the equivalent capacitor;

a sixth switch for passing current from the X side of the equivalent capacitor; and an inductor having a first end coupled to the second unit and another end coupled to ground;

wherein the fifth switch, the sixth switch and the inductor are coupled in series; and a second unit, coupled to the Y side of the equivalent capacitor and coupled to the first unit, for passing current of charging and/or discharging the equivalent capacitor from the Y side.

12. The driver circuit of claim 11 wherein the second unit comprises:

a seventh switch for passing current toward the Y side of the equivalent capacitor; and an eighth switch, serially coupled to the seventh switch for passing current from the Y side of the equivalent capacitor;

wherein the first unit comprises an inductor, in which the inductor has a first end coupled to ground; and wherein the second unit is coupled to an end other than the first end of the inductor of the first unit.

13. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, wherein the first unit comprises:

a fifth switch for passing current toward the X side of the equivalent capacitor;

a sixth switch coupled to the fifth switch in parallel for passing current from the X side of the equivalent capacitor; and an inductor, coupled to the fifth switch and the sixth switch in series, having a first end coupled to the second unit and another end coupled to ground; and a second unit, coupled to the Y side of the equivalent capacitor and coupled to the first unit, for passing current of charging and/or discharging the equivalent capacitor from the Y side.

14. The driver circuit of claim 13 wherein the second unit comprises:

a seventh switch for passing current toward the Y side of the equivalent capacitor; and an eighth switch coupled to the seventh switch in parallel for passing current from the Y side of the equivalent capacitor;

wherein the first unit comprises an inductor, in which the inductor has a first end coupled to ground; and wherein the second unit is coupled to an end other than the first end of the inductor of the first unit.

15. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, wherein the first unit comprises:

a fifth switch for passing current toward the X side of the equivalent capacitor;

a first inductor; and a sixth switch, which is for passing current from the X side and/or the Y side of the equivalent capacitor, having an end coupled to ground;

wherein the fifth switch, the first inductor and the sixth switch are coupled in series; and a second unit, coupled to the Y side of the equivalent capacitor and coupled to the first unit, for passing current of charging and/or discharging the equivalent capacitor from the Y side, wherein the second unit comprises:

a seventh switch for passing current toward the Y side of the equivalent capacitor; and a second inductor coupled to the seventh switch serially;

wherein the second unit is coupled to a first end other than ground of the sixth switch of the first unit.

16. The driver circuit of claim 15 wherein the inductances of the first inductor and the second inductor are different.

17. The driver circuit of claim 15 wherein the inductances of the first inductor and the second inductor are the same.

18. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, wherein the first unit comprises:

a fifth switch for passing current from the X side of the equivalent capacitor;

a first inductor; and a sixth switch, which is for passing current toward the X side and/or the Y side of the equivalent capacitor, having an end coupled to ground;

wherein the fifth switch, the first inductor and the sixth switch are coupled in series; and a second unit, coupled to the Y side of the equivalent capacitor and coupled to the first unit, for passing current of charging and/or discharging the equivalent capacitor from the Y side, wherein the second unit comprises:

a seventh switch for passing current from the Y side of the equivalent capacitor; and a second inductor coupled to the seventh switch serially;

wherein the second unit is coupled to an end other than the ground of the sixth switch of the first unit.

19. The driver circuit of claim 18 wherein the inductances of the first inductor and the second inductor are different.

20. The driver circuit of claim 18 wherein the inductances of the first inductor and the second inductor are the same.

21. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, wherein the first unit comprises:

a fifth switch, which is for passing current toward the X side of the equivalent capacitor, having the first end coupled to the X side of the equivalent capacitor;

an inductor for passing current of from and/or toward the X side and/or the Y side of the equivalent capacitor; and a sixth switch for passing current from the X side and/or the Y side of the equivalent capacitor;

wherein the fifth switch, the inductor and the sixth switch are coupled in series; and a second unit, coupled to the Y side of the equivalent capacitor and coupled to the first unit, for passing current of charging and/or discharging the equivalent capacitor from the Y side, wherein the second unit comprises a seventh switch, coupled to the second end of the fifth switch of the first unit, for passing current toward the Y side of the equivalent capacitor.

22. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to a third voltage source;

a fourth switch having a first end coupled to the second end of the second switch and a second end coupled to a fourth voltage source; and an energy recovery circuit comprising:

a first unit, coupled to the X side of the equivalent capacitor and coupled to ground, for passing current of charging and/or discharging the equivalent capacitor from the X side and/or Y side, wherein the first unit comprises:

a fifth switch, which is for passing current from the X side of the equivalent capacitor, having the first end coupled to the X side of the equivalent capacitor;

an inductor for passing current from and/or toward the X side and/or the Y side of the equivalent capacitor; and a sixth switch for passing current toward the X side and/or the Y side of the equivalent capacitor;

wherein the fifth switch, the inductor and the sixth switch are coupled in series; and a second unit, coupled to the Y side of the equivalent capacitor and coupled to the first unit, for passing current of charging and/or discharging the equivalent capacitor from the Y side, wherein the second unit comprises a seventh switch, coupled to the second end of the fifth switch of the first unit, for passing current from the Y side of the equivalent capacitor.

* * * * *